US006901238B2

(12) United States Patent
Giannetti et al.

(10) Patent No.: US 6,901,238 B2
(45) Date of Patent: May 31, 2005

(54) FUSER ENTRY GUIDE WITH VARIABLE VACUUM FOR A MARKING ENGINE

(75) Inventors: John Giannetti, Penfield, NY (US); Giovanni B. Caiazza, Rochester, NY (US); Jerome F. Sleve, Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/767,569

(22) Filed: Jan. 29, 2004

(65) Prior Publication Data

US 2004/0184854 A1 Sep. 23, 2004

Related U.S. Application Data

(60) Provisional application No. 60/448,444, filed on Feb. 20, 2003.

(51) Int. Cl.[7] ..... G03G 15/00; B65H 13/32

(52) U.S. Cl. ..... 399/400; 399/388; 399/389; 399/397; 271/196; 271/197

(58) Field of Search ..... 399/400, 397, 399/389, 388; 271/196, 197

(56) References Cited

U.S. PATENT DOCUMENTS

| | | | | | |
|---|---|---|---|---|---|
| 5,749,039 | A | * | 5/1998 | Thomas | 399/397 |
| 5,915,149 | A | * | 6/1999 | Anderson et al. | 399/124 |
| 6,026,276 | A | * | 2/2000 | Malachowski | 399/400 |
| 6,169,864 | B1 | * | 1/2001 | Baxendell et al. | 399/106 |
| 6,185,385 | B1 | * | 2/2001 | Mestha et al. | 399/49 |
| 6,505,030 | B1 | * | 1/2003 | Santiago et al. | 399/389 |

* cited by examiner

*Primary Examiner*—Andrew H. Hirshfeld
(74) *Attorney, Agent, or Firm*—Kevin L. Leffel; Richard A. Romanchik

(57) ABSTRACT

A method and apparatus for increasing the efficiency of a vacuum-assisted, fuser entrance guide in a marking engine by varying the vacuum on the guide as a sheet of marking medium moves thereacross wherein a low vacuum is applied on the guide while the sheet of marking medium is being transported across the guide solely by the vacuum transport and is then increased once the lead edge of the sheet enters the nip between the fuser rollers and the sheet becomes driven by the more powerful force of the fuser rollers. The higher vacuum provides a greater attraction force on the sheet, which, in turn, prevents the trail edge of the sheet from sagging or drooping from the guide's surface.

20 Claims, 1 Drawing Sheet

FUSER ENTRY GUIDE WITH VARIABLE VACUUM FOR A MARKING ENGINE

This application claims the benefit of provisional application Ser. No. 60/448,444 filed Feb. 20, 2003.

FIELD OF THE INVENTION

The present invention relates to a fuser entrance guide for a marking engine and in one of its aspects relates to a vacuum assisted guide positioned at the entrance of a fuser section wherein the vacuum being applied at the guide can be varied as a sheet moves across the guide.

BACKGROUND OF THE INVENTION

In certain marking engines (e.g. copier, duplicator, printer, etc.), a continuous loop of a photoconductor film is commonly used to transfer an image from an input section onto a marking medium (e.g. a sheet of paper or the like). The film is initially charged and passed through the input section where an image is projected onto the charged film. The film then moves through a developing section where toner is applied to the charged image, and on through an image transfer section where the toner image is transferred onto a sheet of paper or some other marking medium. The toner image is then fixed (i.e. fused) to the sheet by passing the sheet between a pressure roller and a heated roller within the fuser section of the machine.

In such machines, it is common to use a vacuum transport to transfer the sheet from the image transfer section (i.e. film loop) to the fuser section. Often this vacuum transport is directly interfaced between the film and the fuser section whereby the vacuum transport receives the sheet from the film and passes it directly into nip between the rollers in the fuser section. This requires that the surface speeds of (a) the film loop, (b) the vacuum transport belt(s), and (c) the fuser rollers all have to be closely matched. If the speeds become mismatched, there may be relative movement between the film and the sheet while the image is being transferred thereby resulting in smearing of the image on the sheet.

To alleviate this problem, some commercial machines have abandoned such a direct interface and instead, now use a extended travel path between the image transfer and fuser section which is longer than the straight-line distance between these two sections (i.e. longer than the length of any sheet to be used in the marking operations). This extended path effectively "de-couples" the speed of the fuser rollers from the speed of the film thereby eliminating the possibility of relative movement between the sheet and the film as the toner image is being transferred onto the sheet.

The travel path is extended by angling the vacuum transport away from the straight-line distance between the sections and then positioning a fuser entrance guide between the exit end of the vacuum transport and the entrance of the fuser section. The fuser guide is normally vacuum assisted which holds the sheet against the surface of the guide as the sheet moves from the vacuum transport into the fuser section. This type of extended travel path and vacuum-assisted guide is known and has been used in commercially available machines, e.g. DIGIMASTER 9110, Heidelberg Digital L.L.C., Rochester, N.Y.

As a sheet moves along the extended travel path, it is particularly important to prevent the sheet (e.g. trail edge of sheet) from falling away from the fuser entrance guide as it moves across the surface of the guide. If the sheet should sag or drop, it may contact and slide across other elements in the paper path before it enters the fuser section which, in turn, is likely to cause smearing of the unfused image on the sheet thereby making the print unacceptable to the user.

To prevent such sagging, the vacuum being applied at the guide must be strong enough to hold even the heaviest sheet used in marking operations firmly in contact with the guide's surface until the trail edge of the sheet has completely entered the nip between the fuser rollers. Unfortunately, this may be difficult to achieve since a vacuum that is strong enough to hold the heavier sheets against the guide's surface may also be too strong to allow those sheets to readily move across the surface. That is, if the vacuum is too strong, it may adversely affect the ability of the vacuum transport to move the sheet across the guide. When this happens, the sheet slows or stalls completely on the guide's surface thereby resulting in serious jamming problems or the like.

Therefore, it is important to provide a vacuum force on the guide which will hold even the heaviest sheet in contact with guide surface until the sheet has moved completely across the surface of the guide but, at the same time, will allow the vacuum transport to readily move the lead edge of the sheet across the guide and into the nip between the fuser rollers without the sheet slowing or stalling on the guide's surface.

SUMMARY OF THE INVENTION

Basically, the present invention provides a method and apparatus for increasing the efficiency of a vacuum-assisted, fuser entrance guide in a marking engine by varying the vacuum on the guide as a sheet moves thereacross. That is, a low vacuum is applied on the guide while the sheet of marking medium is being transported across the guide solely by the vacuum transport. This low vacuum force is strong enough to hold the sheet against the guide but is not so strong as to cause the sheet to stall on the guide. The vacuum is then increased once the lead edge of the sheet enters the nip between the fuser rollers and the sheet becomes driven by the more powerful force of the fuser rollers. The higher vacuum provides a greater attraction force on the sheet, which prevents the trail edge of the sheet from sagging or drooping from the guide's surface.

More specifically, the present invention provides an electrophotographic machine for printing an image onto a sheet of a marking medium (e.g. paper) wherein the machine is basically comprised of an image transfer section (e.g. a continuous loop of film) for transferring the image to the sheet, a fuser section, and a travel path for transporting the sheet from the film to the fuser section. The travel path, in turn, is comprised of a (a) vacuum transport which receives the sheet from the film and moves it towards the fuser and (b) a vacuum-assisted, fuser entrance guide for receiving the sheet from the vacuum transport and guiding it into the fuser section. The fuser entrance guide is comprised of a housing which is adapted to maintain a vacuum therein and a base plate which, in turn, has ports its lower surface through which the vacuum in the housing is to applied to a sheet to hold the sheet against the guide as the sheet moves between the image transfer and fuser sections.

In accordance with the present invention, the fuser entrance guide includes apparatus operative to vary the vacuum in the housing as the sheet moves across the lower surface of the fuser entrance guide. This apparatus comprises a vacuum source, which is fluidly connected by a vacuum line to the housing of the guide and a valve in the vacuum line for controlling the vacuum level or force in the housing. The position of the sheet is determined. For example, a sensor may be positioned along the vacuum transport for sensing and generating a signal as the trail edge of the sheet moves past the sensor. Alternatively the sensor may generate a signal in response to the lead edge moving past the sensor, since the position of the trail edge is known if the sheet size is known. Sheet size may be determined from job scheduling. The signal may also be based on one or more timing signals generated by movement of the photoconductor member, for example by an encoder, or perforations in the photoconductor member.

A programmed controller receives the signal and, after a first "time delay", actuates the valve to increase the vacuum in said housing as the trail edge of the sheet moves across said fuser entrance guide. This first time delay is initiated by the signal from the sensor and delays actuation of the valve to increase the vacuum until the lead edge of the sheet is in engagement with the fuser section and said sheet is being driven by the fuser rollers. Once the vacuum has been increased, a second "time delay" is initiated to maintain the increased vacuum on said fuser entrance guide until the trail edge of the sheet has moved substantially across the fuser entrance guide. At the end of the second time delay, the valve is again actuated to return the vacuum to its lowest level before arrival of the lead edge of the following sheet at the guide and the cycle is repeated for each individual sheet.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DESCRIPTION OF THE PREFERRED EMBODIMENT

Figure 1:
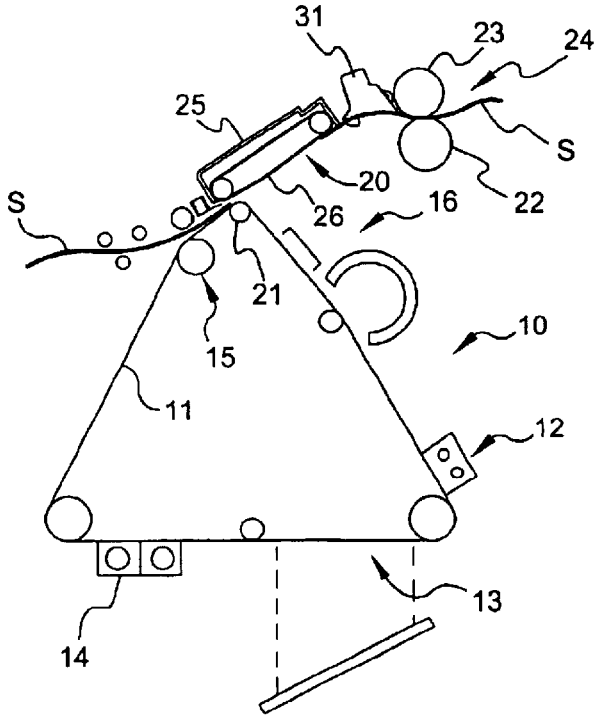
FIG. 1 is a schematic view of an electrophotographic apparatus (e.g. copier/printer machine) in which the present invention is incorporated.

FIG. 1 illustrates a marking engine 10 (e.g. copier, duplicator, printer), for example an electrophotographic machine, in which the present invention can be incorporated. Marking engine or machine 10 is of the type that uses an endless photoconductor member 11 (e.g. photographic film) to transfer a marked representation of an inputted image onto a sheet S of a marking medium. The film moves through a closed loop past a charging section 12, an exposure or input section 13, a developing section 14, an image transfer section 15, and an erase/clean section 16. Sheet S of a marking medium (e.g. paper) is fed from a supply (not shown) through image transfer section 15 where the toner image on the film 11 is transferred to the sheet S. Sheet S is then fed along a travel path 20 from a detack roller 21 in the image transfer section 15 to a fuser section 24 where the sheet S passes through the "nip" between a fusing roller 22 and a pressure roller 23 to thereby "fuse" the toner image onto sheet S before the sheet exits the machine.

Figure 2:
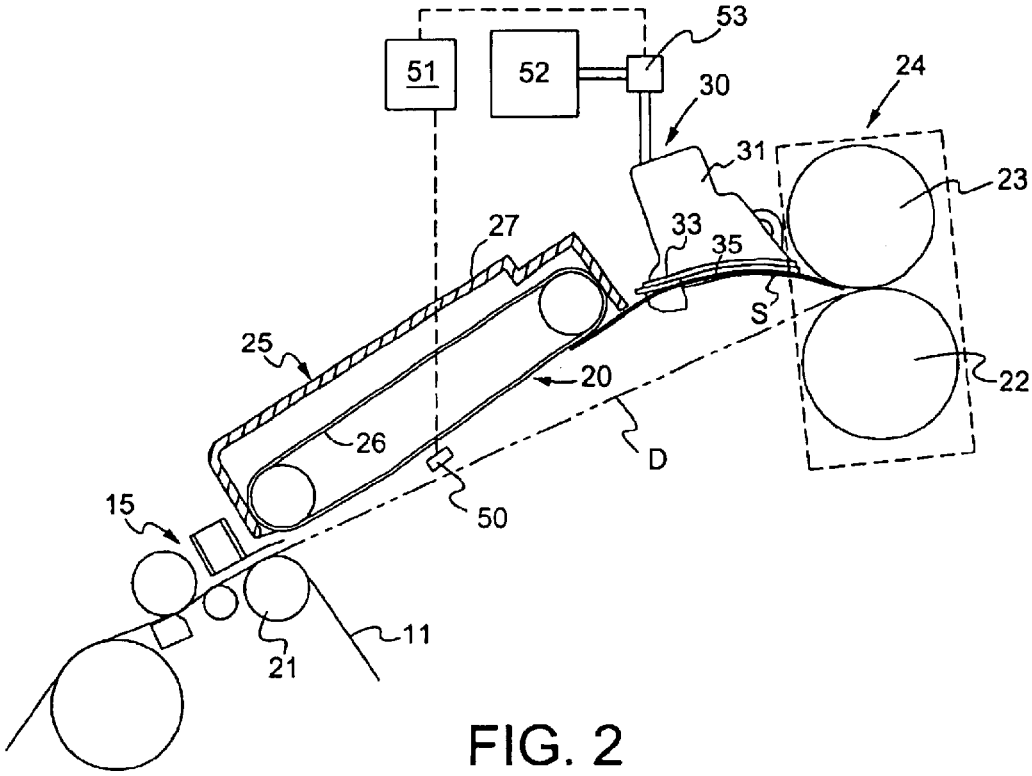
FIG. 2 is an enlarged, sectional view of the paper travel path of the apparatus of FIG. 1 having the present invention incorporated therein.

FIG. 2 is an enlarged, cross-sectional view of the travel path 20 of FIG. 1 and is comprised of a vacuum transport 25 and a fuser entrance guide 30, the latter being positioned between the exit end of vacuum transport 25 and the entrance of fuser section 24. The vacuum transport 25 is of the type well known in the art and basically is comprised of an endless, perforated belt(s) 26 which moves over a stationary, perforated plate (not shown) within a housing 27. As will be understood in the art, a pressurized stream of air (not shown) is flowed through housing 27 to create a vacuum. This vacuum acts through cooperating openings (not shown) in the plate/belt to hold the sheet S against the belt 26 as the belt moves the sheet towards the fuser section 24.

As seen in FIG. 2, travel path 20 is "extended" in that vacuum transport 25 is angled with respect to D (i.e. the straight-line distance between detack roller 21 and fuser section 24). By making the travel path 20 longer than D, guide 30 provides a "buffer" zone which effectively "decouples" the speed of the detack roller 21 from the speed of fuser rollers 22, 23. This allows the trail edge of sheet S (even the longest sheet used) to be completely clear of detack roller 21 before the leading edge of the sheet is delivered to the nip between the fuser rollers 22, 23. This prevents any relative movement between the film 11 and sheet S when the sheet and the film are in contact with each other, thereby eliminating possible smearing as the toner image is being transferred onto sheet S.

However, some smearing may still occur if the trail edge of sheet S sags or drops from fuser entrance guide 30 and comes into contact with other elements in the travel path before the trail edge of sheet S has completely entered the fuser section 24. To alleviate this possibility, air from air blower 52 is delivered to housing 31 of guide 30 through valve 53 to create a vacuum within the housing 30. This vacuum acts through the ports 33 in the base plate 35 of guide 30 to hold the sheet S against the base plate as the vacuum transport 25 moves sheet S towards the fuser section 24.

In prior machines of this type, the number and placement of vacuum ports 33 in base plate 35 are designed so that the holding force of the vacuum (i.e. force necessary to hold the sheet on the base plate) is balanced against the drag forces produced by the vacuum on the moving sheet. That is, the vacuum applied against the sheet has to be strong enough to hold the sheet in contact with the guide but cannot be so strong as to stall or seriously the vacuum transport's 25 ability to move sheet S across guide 30 and into fuser 24. For a more complete description of such a travel path and fuser entrance guide 30, see co-pending and commonly assigned U.S. patent provisional application, Ser. No. 60/412,771 filed Sep. 23, 2002, which is incorporated by reference herein in its entirety.

While fuser entrance guides of this type have proven successful in most printing operations, there still remains a problem where heavier marking medium sheets (e.g. heavy paper, etc.) are needed for a particular operation. It is extremely difficult, if possible at all, to provide a steady vacuum for guide 30 which will hold the heavier sheets against the guide until the sheet has completely cleared the guide and at the same time not impede the movement of the sheet across the guide's surface. It has been found that there is a tendency for the trail edge of the sheet to sag or drop away from the guide before sheet has move completely across the guide.

In accordance with the present invention, instead of maintaining a constant vacuum at the guide 30, the vacuum is varied as sheet S passes across the surface of guide 30.

Basically, the vacuum is at its lowest level when the "lead edge" of sheet S is traveling across guide 30 and is increased as the "trail edge" of the sheet moves across the guide. That is, when the lead edge of the sheet first engages the guide 30, it is being transported solely the vacuum transport 25, which, in turn, has a relatively low driving force. Accordingly, it is desirable to have a lowest vacuum force holding the sheet to the guide during this time to prevent stalling of the sheet on the guide.

When the trail edge approaches the guide 30, the lead edge of the sheet S will now be in engaged within the nip between the rollers 22, 23 whereby sheet S is now being transported by the rollers which, in turn, provide a much higher driving force than the vacuum transport 25. This allows a higher vacuum to now be applied on guide 30 without stalling the sheet on the guide.

Better attraction of the trail edge of the sheet provided by the higher vacuum reduces or eliminates the tendency a sheet to detach from the guide, which can cause smearing of the image on the sheet. This increased attraction is realized without introducing any additional drag forces on the sheet while it is being transported by the vacuum transport. That is, by increasing the vacuum during the travel of the trail edge across the guide allows heavier sheets to be used without stalling than in marking operations where a constant vacuum was applied to guide 30.

Referring again to FIG. 2, a sensor 50 (e.g. optical, mechanical, or the like) may be positioned intermediate the ends of the vacuum transport 25 and is adapted to sense the trail edge of sheet S as it is moved by vacuum transport 25 from detack roller 21 towards fuser section 24. Sensor 50 is positioned so that the trail edge of sheet S will be sensed after the lead edge of sheet S has arrived at fuser entrance guide 30. Alternatively the sensor 50 may generate a signal in response to the lead edge moving past the sensor, since the position of the trail edge is known if the sheet size is known. Sheet size may be determined from job scheduling. The signal may also be based on one or more timing signals generated by movement of the photoconductor member, for example by an encoder, or perforations in the photoconductor member. Combinations of these may be implemented in the practice of the invention, and it is not intended to limit the invention to any particular way of determining the position of the sheet.

As the trail edge of sheet S unblocks sensor 50, the resulting signal is transmitted to an appropriately, programmed controller 51 (e.g. CPU, ROM, etc.). This signal initiates a programmed first "time delay" (e.g. 150 milliseconds) which is based on the speed of sheet S. The translation from the low to high vacuum is delayed until the trail edge of sheet S reaches the fuser entrance guide 30 and the sheet is now being driven by the fuser rollers. It should be noted that the size of sheet S is not a factor since it is the trail edge of the sheet that is being used as the reference point for increasing the vacuum.

At this point, since sheet S is now within the nip between fuser rollers 22, 23 and is being pulled thereby into fuser section 24, the vacuum on guide 30 can now be increased without impeding the travel of sheet S across the guide. As the first "time delay" expires, a signal from controller 51 actuates valve 53 (e.g. solenoid valve or the like) in the vacuum line of a vacuum source 52 (e.g. air blower) to increase the vacuum being applied on the surface of guide 30. By increasing the vacuum, the trail edge of sheet S can not droop or sag downward off the surface of guide 30 thereby preventing the possibility of smearing of the image on sheet S.

As the vacuum goes "high", a second "time delay" is initiated which allows the vacuum on guide 30 to remain "high" until the trail edge of sheet S has traveled far enough towards fuser section 24 so that it can no longer droop away from guide 30. At this point, valve 53 is actuated to move it back to its original position to return the vacuum in housing 31 to its low value. This return to low vacuum also coincides with the arrival of the lead edge of a following sheet at guide 30 so that again there will be minimal drag on the sheet during the time the sheet is being advanced solely by the vacuum transport 25. The cycle is repeated for each sheet in the job stream and will operate properly regardless of the length of the individual sheets because each cycle is always initiated by the trail edge of that particular sheet.

By varying the vacuum on guide 30, the relatively low vacuum holds the sheet S against the guide and does not impede its movement across the guide while the sheet is being moved solely by vacuum transport 25. Once the lead edge of the sheet is in the nip between rollers 22, 23 and is being pulled into the fuser, the vacuum is increased which hold the trail edge firmly against the guide to prevent drooping without slowing movement of the sheet across the guide.

A controller and supporting software are implemented to control the various functions described herein. Such implementation is well within ordinary skill in the relevant art. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. The control implementation may be expressed in software, hardware, and/or firmware.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof. The claims should not be read as limited to the described order of elements unless stated to that effect. In addition, use of the term "means" in any claim is intended to invoke 35 U.S.C. §112, paragraph 6, and any claim without the word "means" is not so intended.

What is claimed is:

1. A marking engine for marking an image onto a sheet, said marking engine having an image transfer section, a fuser section, and a travel path for transporting said sheet from said image transfer section to said fuser section, said travel path comprising:

a vacuum transport for receiving said sheet from said image transfer section and moving said sheet towards said fuser; and a fuser entrance guide for receiving said sheet from said vacuum transport and guiding said sheet into said fuser section, said guide comprising:

a housing adapted to maintain a vacuum therein;

a base plate on said housing; said base plate having a lower surface adapted to be contacted by said sheet as said sheet moves between said image transfer and fuser section, said lower surface having vacuum ports therein through which said vacuum in said housing is applied against said sheet; and a controller operative to vary said vacuum in said housing as said sheet moves across said lower surface of said fuser entrance guide.

2. The marking engine of claim 1 comprising:

a vacuum source fluidly connected to said housing;

a valve for controlling the vacuum from said vacuum source into said housing;

a sensor positioned along said vacuum transport for sensing said sheet and generating a signal as said sheet moves past said sensor; and said controller being operative to receive said signal and actuate said valve to increase said vacuum in said housing as said sheet moves across said fuser entrance guide.

3. The marking engine of claim 2 wherein said sensor senses the trail edge of said sheet as said sheet moves along said vacuum transport.

4. The marking engine of claim 3 wherein said controller includes a first time delay which is initiated by said signal from said sensor to thereby delay actuation of said valve and increase said vacuum until the lead edge of said sheet is in engagement with said fuser section and said sheet is being driven thereby.

5. The marking engine of claim 4 wherein said controller includes a second time delay which is set to maintain the increased vacuum on said fuser entrance guide until said trail edge of said sheet has moved substantially across said fuser entrance guide.

6. The marking engine of claim 2 wherein said sensor senses the lead edge of said sheet as said sheet moves along said vacuum transport.

7. The marking engine of claim 1 wherein said controller is operative to vary said vacuum based on one or more timing signals generated by movement of an electrophotographic member.

8. A fuser entrance guide for a marking engine comprising:

a vacaum transport for receiving a sheet from an image transfer section, a housing adapted to be positioned between said vacuum transport and the fuser section within said marking engine, said housing adapted to maintain a vacuum therein;

a base plate on said housing; said base plate having a lower surface adapted to be contacted by said sheet as said sheet moves between said film and fuser section, said lower surface having ports therein through which said vacuum is applied to said sheet; and a controller operative to vary said vacuum in said housing as said sheet moves across said lower surface of said fuser entrance guide.

9. A fuser entrance guide of claim 8 comprising:

a vacuum source fluidly connected to said housing;

a valve for controlling the vacuum from said vacuum source into said housing;

a sensor positioned along said vacuum transport for sensing said sheet and generating a signal as said sheet moves past said sensor; and said controller being operative to receive said signal and actuate said valve to increase said vacuum in said housing as said sheet moves across said fuser entrance guide.

10. A fuser entrance guide of claim 9 wherein said sensor senses the trail edge of said sheet as said sheet moves along said vacuum transport.

11. A fuser entrance guide of claim 10 wherein said controller includes a first time delay which is initiated by said signal from said sensor to thereby delay actuation of said valve and increase said vacuum until the lead edge of said sheet is in engagement with said fuser section and said sheet is being driven thereby.

12. A fuser entrance guide of claim 11 wherein said controller includes a second time delay which is set to maintain the increased vacuum on said fuser entrance guide until said trail edge of said sheet has moved substantially across said fuser entrance guide.

13. A fuser entrance guide of claim 9 wherein said sensor senses the lead edge of said sheet as said sheet moves along said vacuum transport.

14. A fuser entrance guide of claim 8 wherein said controller is operative to vary said vacuum based on one or more timing signals generated by movement of an electrophotographic member.

15. A method of guiding a sheet from a vacuum transport in a marking engine into a fuser section of said engine, said method comprising:

providing a guide between the exit of said vacuum transport and the entrance of said fuser section;

applying a vacuum through the lower surface of said guide to attract and hold said sheet against said lower surface; and varying said vacuum as said sheet moves from said vacuum transport towards said fuser section, said vacuum being at its lowest level as the lead edge of said sheet engages said guide and being at its highest level as the trail edge of said sheet passes across said guide.

16. The method of claim 15 wherein the step of varying said vacuum includes:

increasing said vacuum to its highest level after said sheet enters and becomes driven by said fuser section.

17. The method of claim 16 including:

returning said vacuum to its lowest level after said trail edge of said sheet has moved substantially across said guide.

18. The method of claim 15 including:

sensing the trail edge of said sheet as said sheet moves along said vacuum transport and generating a signal in response thereto; and increasing said vacuum to its highest level in response to said signal; and returning said vacuum to its lowest level after said trail edge of said sheet has moved substantially across said guide.

19. The method of claim 18 including:

delaying the increase in vacuum from the time said trail edge of said sheet is sensed along said vacuum transport until said trail edge reaches said guide.

20. The method of claim 19 including:

delaying returning of said vacuum to its lowest level until the trail edge of said sheet has moved substantially across said guide.

* * * * *